United States Patent [19]

Segrest

[11] 4,321,878

[45] Mar. 30, 1982

[54] SECONDARY HEARTH CREMATORY

[76] Inventor: William W. Segrest, 107 N. Wood Lake Dr., Maitland, Fla. 32751

[21] Appl. No.: 166,497

[22] Filed: Jul. 7, 1980

[51] Int. Cl.[3] ..... F23G 1/00

[52] U.S. Cl. ..... 110/194; 110/212; 110/225

[58] Field of Search ..... 110/194, 208, 210–212, 110/227; 432/133, 136, 144, 146

[56] References Cited

U.S. PATENT DOCUMENTS

| | | | |
|---|---|---|---|
| 1,421,919 | 7/1922 | Davidson et al. | 110/194 |
| 1,742,868 | 1/1930 | Mann | 110/194 |
| 3,136,273 | 6/1964 | Blesch et al. | 110/194 |
| 3,172,647 | 3/1965 | Remmey | 432/133 |
| 3,538,864 | 11/1970 | Segrest | 110/194 |
| 3,780,674 | 12/1973 | Liu | 110/212 |
| 3,874,310 | 4/1975 | Falling | 110/194 |
| 4,182,246 | 1/1980 | Lombana et al. | 110/225 |

FOREIGN PATENT DOCUMENTS

| | | | |
|---|---|---|---|
| 2032596 | 5/1980 | United Kingdom | 110/194 |

*Primary Examiner*—Henry C. Yuen

*Attorney, Agent, or Firm*—Duckworth, Allen, Dyer & Pettis

[57] ABSTRACT

A cremator is provided with a primary cremation chamber and a secondary cremation chamber adjacent to and in communication with the first chamber. A method of cremating bodies utilizing the apparatus disclosed wherein a body is eighty percent consumed in the primary chamber and is then moved to the secondary chamber wherein it is consumed together with the by-products of the cremation of a second body in the primary chamber. Cremation in the secondary chamber utilizes the heat of combustion of the second body in the primary chamber to increase the efficiency of the system.

7 Claims, 8 Drawing Figures

FIG. 1
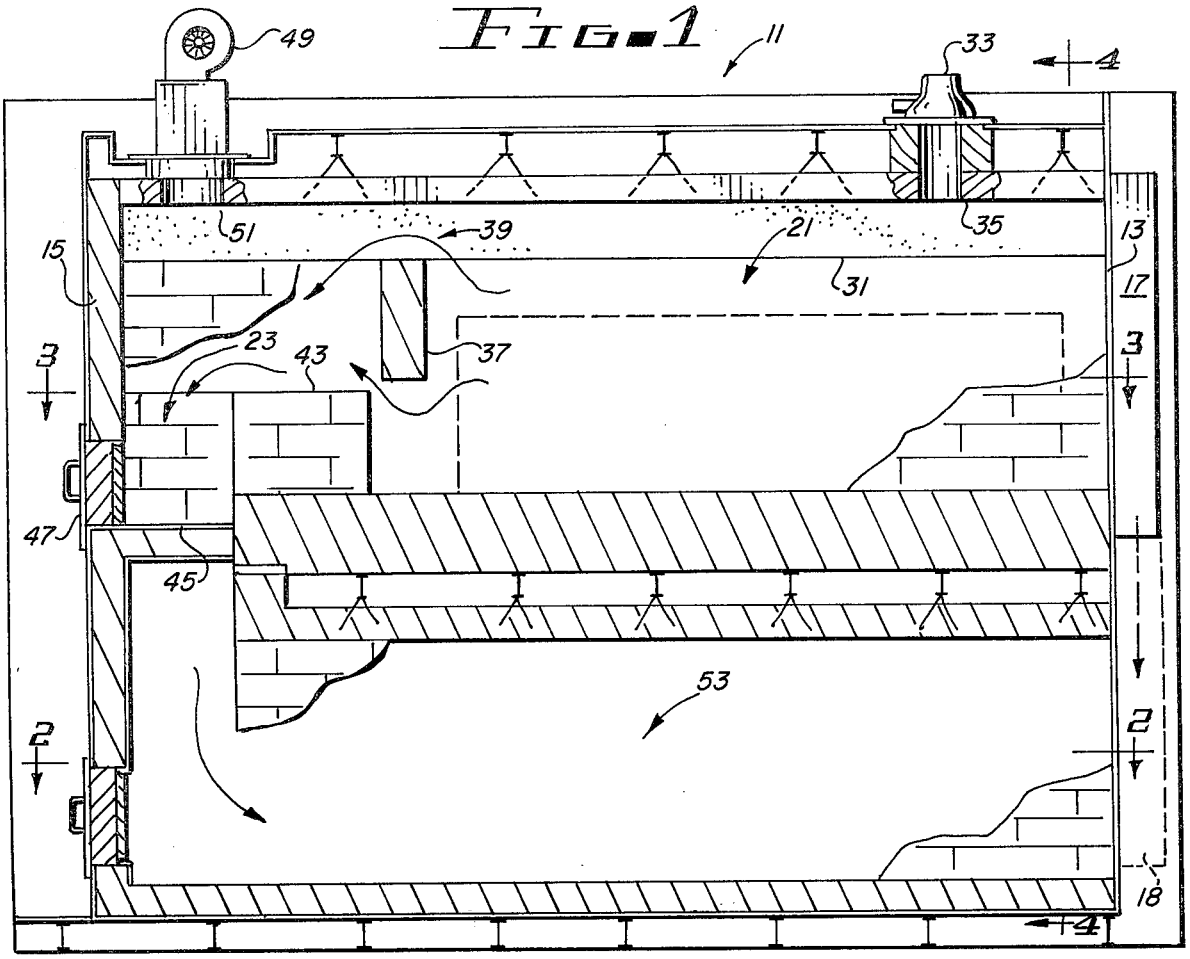
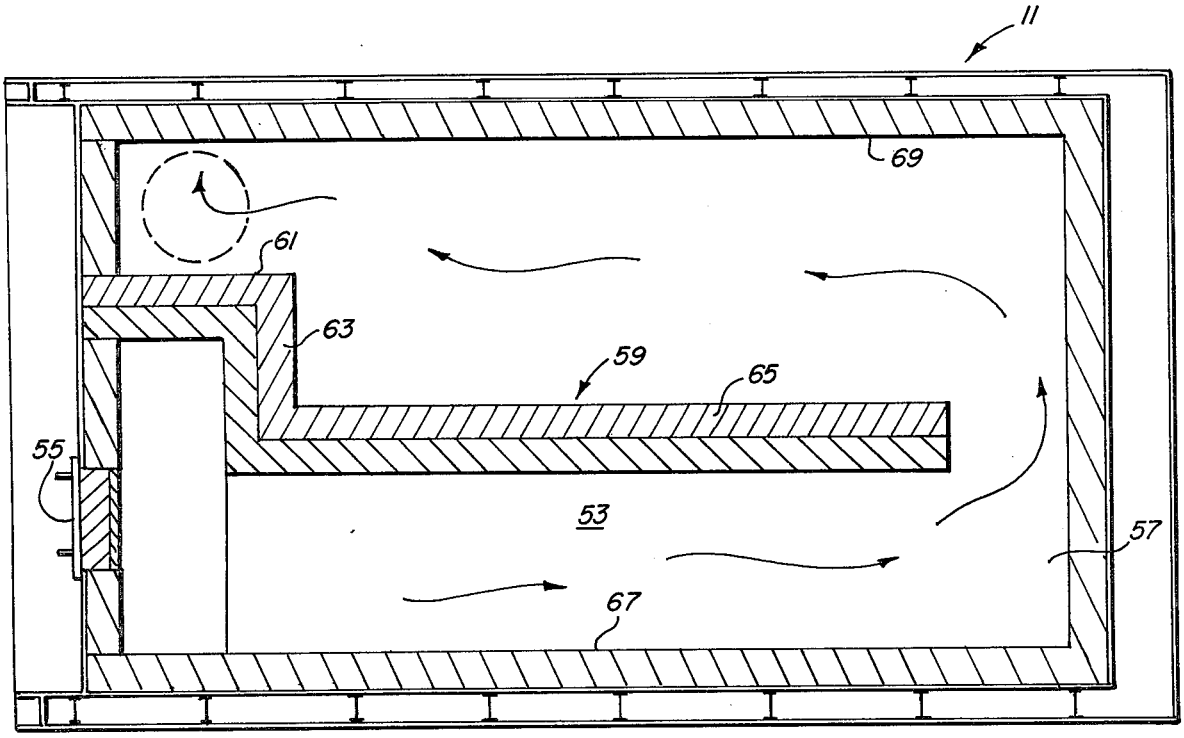
FIG. 2

FIG. 7
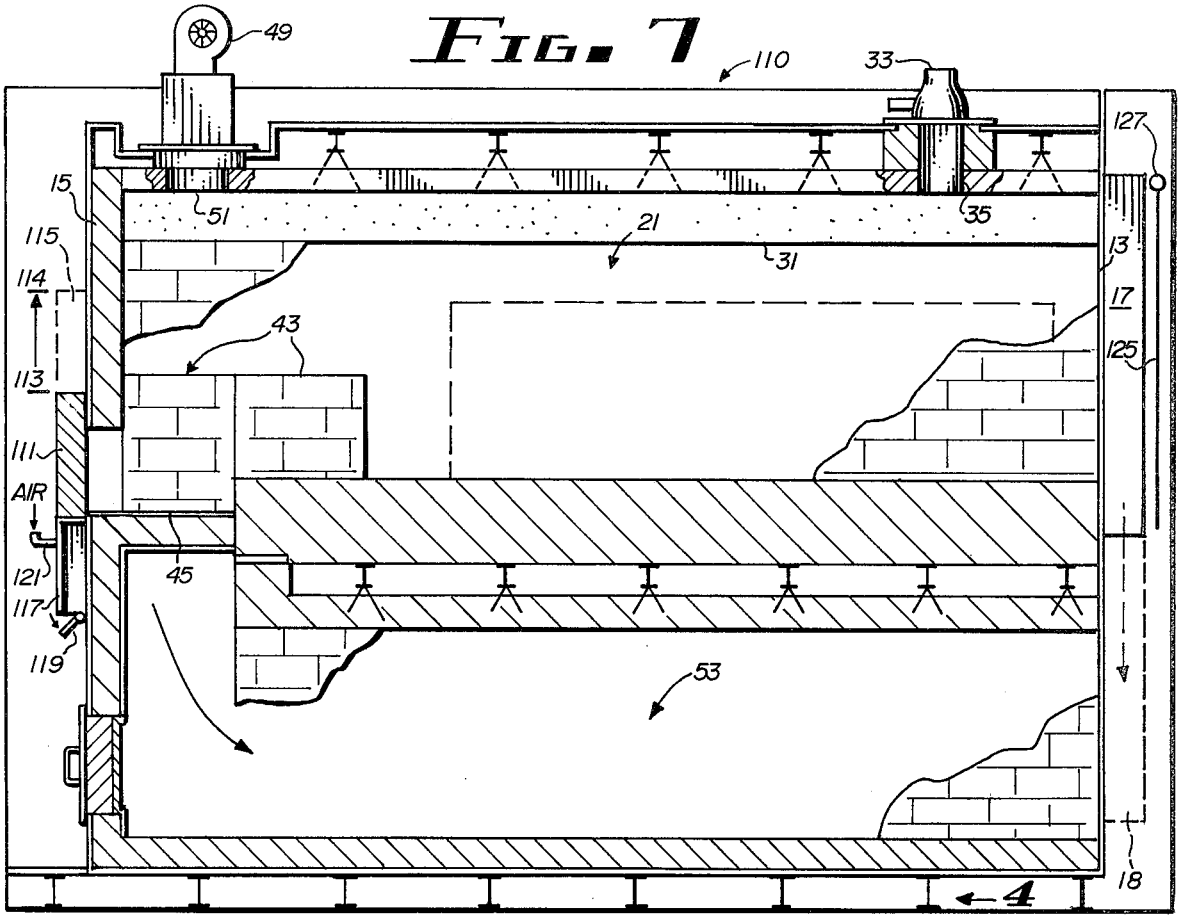
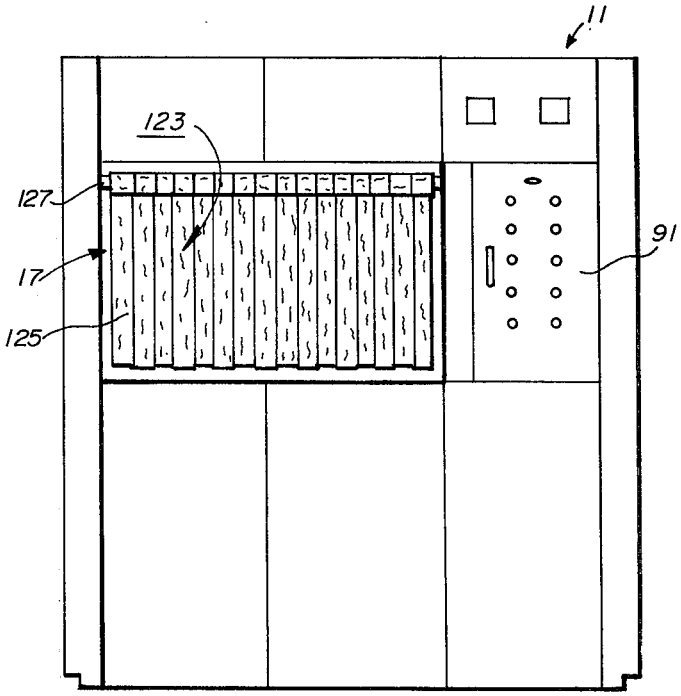
FIG. 8

SECONDARY HEARTH CREMATORY

BACKGROUND OF THE INVENTION

This invention relates generally to a method and apparatus for cremating bodies and more particularly to the efficient cremation of a body by utilizing the heat of consumption of a second body to efficiently finish the consumption of a first body.

Cremation as a means for disposing of the bodies of humans in an ancient art. Numerous improvements have been made to the ancient methods with the object of achieving greater efficiency. In U.S. Pat. No. 1,212,307 (Adams, Jan. 16, 1917), a cremation furnace was described having a casket chamber and a furnace pit with burners directed downwardly into the pit together with a long narrow air conduit leading to the bottom of the furnace pit and an air conduit leading through the wall and discharging immediately beneath the casket so that fluid fuels could be burned without noise and vibration. U.S. Pat. No. 1,421,919 (Davidson, July 4, 1922), discloses a crematory having a plurality of combustion chambers that could be operated by one heat unit, together with means for circulating the heated gases through the chambers, means for individually controlling the circulation in each of such chambers, means for consuming smoke arising from the combustion chambers, and means to prevent the transmission of vibration from the furnace to the combustion chambers and means to create a supply of heat. In Davidson, the combustion chambers were not in communication with each other, and consumption of the body took place in a single chamber. In U.S. Pat. No. 3,136,273 (Blesch, June 9, 1964), a method and apparatus for cremation is disclosed wherein a body is placed in a chamber substantially free of oxygen and subjected to high temperatures to drive off volatiles which are piped and burned in a separate furnace after the volatiles are driven off, the the carbon is consumed in the presence of oxygen by applying a higher temperature to the chamber leaving the conventional mineral ash. Another reference of interest is U.S. Pat. No. 3,176,634 (Martin, Jan. 29, 1963) wherein a fireball incenerator is disclosed for cremating poultry.

The disadvantage with the systems described is that the rate of consumption of a body varies according to the amount of the body that has been consumed, and in the systems described the body must be totally consumed in the chamber provided before another body can be cremated. Another disadvantage is that the systems described in the prior art do not utilize the heat of consumption of the body being cremated, thus leading to inefficient energy use.

SUMMARY OF THE INVENTION

The improved device for cremating bodies according to the present invention is characterized by a primary cremation chamber and a secondary cremation chamber adjacent to and in communication with the primary chamber. Means for creating a flow from the primary chamber to the secondary chamber and from the secondary chamber to an exhaust are provided so that the heat of combustion of a body in the primary chamber can be used to consume a partially consumed body in the secondary chamber. The method of cremation of the present invention is characterized by the steps of partially cremating a body (e.g., up to eighty percent complete) and then moving the partially cremated remains to the secondary chamber. Thereafter, a second body is loaded in the primary chamber wherein it will undergo cremation and the heat of combustion of the second body is utilized in conjunction with an after burner to finish the cremation of the first body.

BRIEF DESCRIPTION OF THE DRAWINGS

Further details are explained below with the help of examples illustrated in the attached drawings in which:

FIG. 1 is a cross section through the secondary hearth crematory of the present invention;

FIG. 2 is a plan view of the afterchamber of the present invention;

FIG. 7 is a cross section through an alternative embodiment of the secondary hearth crematory; and FIG. 8 is a front view of the exterior of the alternative embodiment of FIG. 7.

DETAILED DESCRIPTION OF THE INVENTION

Figure 3:
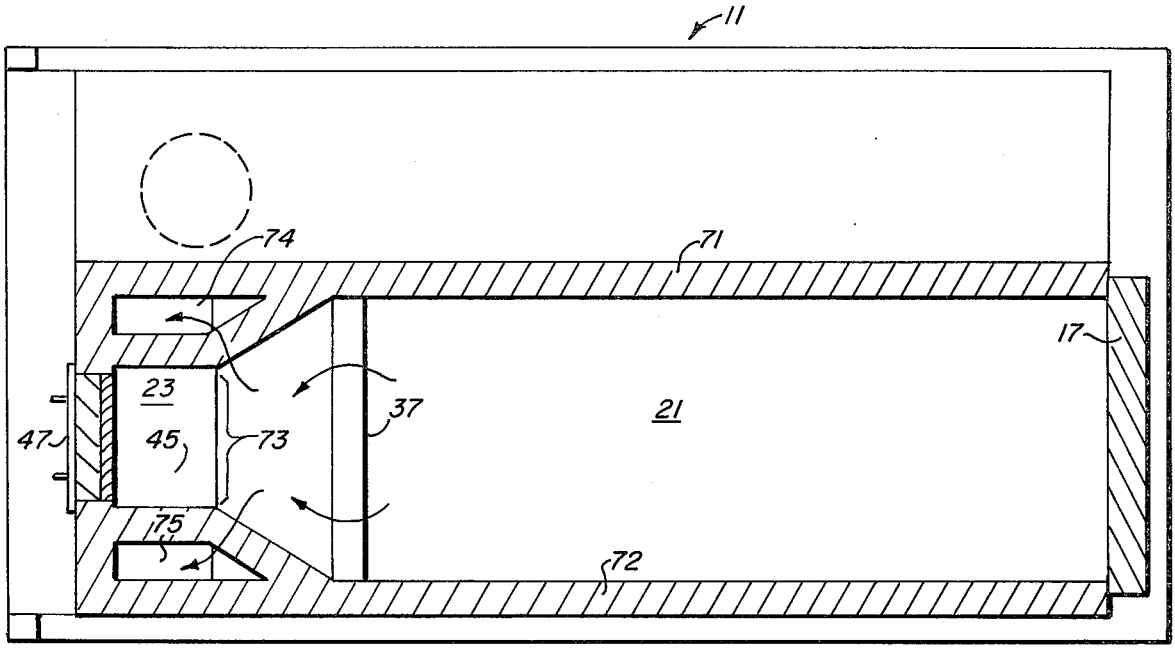
FIG. 3 is a plan view of the primary and secondary cremation chambers.

In FIGS. 1 and 2 a secondary hearth crematory 11 is shown in cross section with a front wall 13 and a rear wall 15. The front wall 13 includes a charging door 17 made of insulating firebrick and which is lowered to position 18 in order to admit a casket with a body. The secondary hearth crematory 11 includes a primary cremation chamber 21 and a secondary cremation chamber 23.

The primary cremation chamber 21 has a primary hearth 25 made of refractory material which may be cast. Disposed above the primary hearth 25 is a top wall 31 also made of refractory material. The top wall 31 extends from the front wall 13 to the rear wall 15 of the secondary hearth crematory 11. A cremation burner 33 is disposed on the top wall 31 and is put in communication with the primary cremation chamber 21 by passage 35.

The primary cremation chamber 21 is separated from the secondary cremation chamber 23 by a curtin wall 37 which provides a top passage 39 and a bottom passage 41 through which flow generally denoted with arrows in FIG. 1 can occur. The secondary chamber 23 is provided with guide walls 43 and a secondary hearth 45 adjacent to the primary hearth. Also disposed on and forming part of the secondary chamber is a remains removal door 47 which is formed in the rear wall of the secondary hearth crematory 11. Disposed in communication with the secondary cremation chamber 23 is an afterburner 49 which is supported by the top wall 31 having afterburner passage 51.

Disposed below the primary and secondary cremation chambers 21 and 23 is an afterburner chamber 53, with afterburner access door 55 formed in the rear wall 15, and bounded on the bottom by floor 57 which is made of refractory brick material.

The afterburner chamber 53 is divided into two sections by divider wall 59 which has a short longitudinal wall section 61, a transverse wall section 63, and a elongated longitudinal wall section 65. The afterburner chamber 53 is provided with afterburner chamber side wall 67 and 69 which are also made of refractory brick material in order to contain the heat.

As shown in FIG. 3 the primary and secondary cremation chambers 21 and 23 are separated by the curtin wall 37. The sides of the cremation chambers 21 and 23 are defined by cremation chamber side walls 71 and 72 made of a refractory wall of dense firebrick. In the secondary cremation chamber 23 the guide walls 43 form a throat 73 leading to the secondary hearth 45. The flow passages 74 and 75 are provided between side wall 71 and 72 and guide walls 43 to place the secondary cremation chamber in communication with the afterburner chamber.

Figure 4:
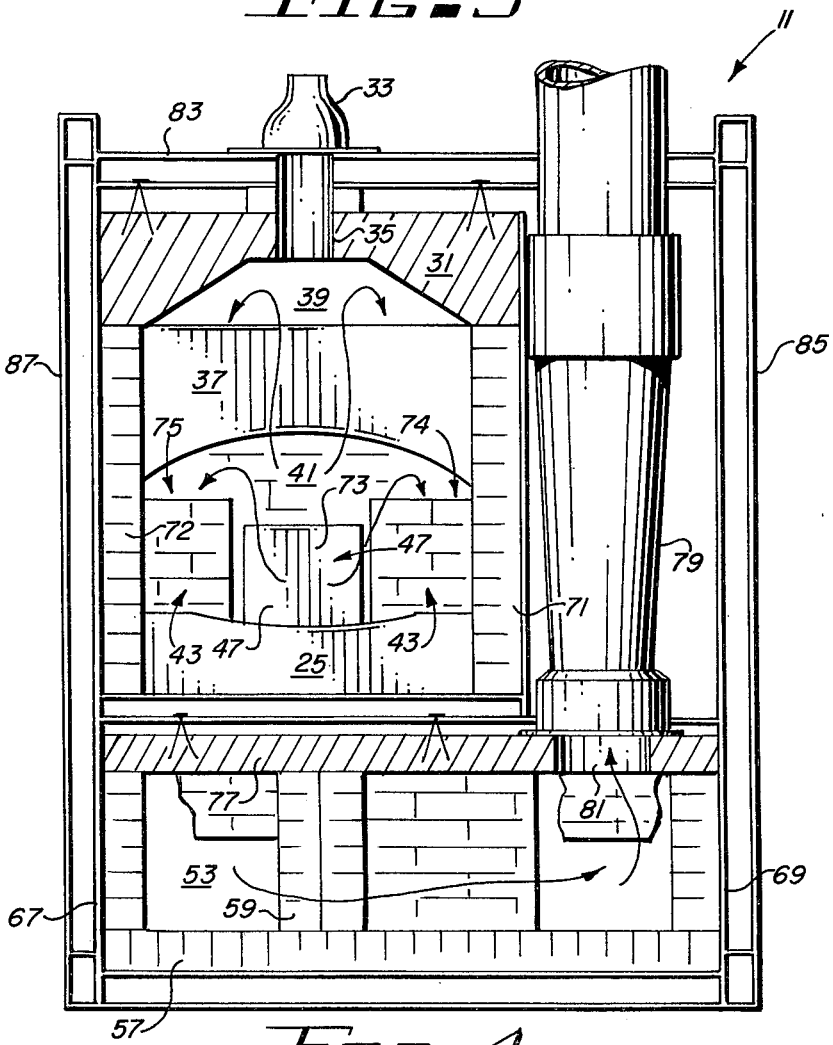
FIG. 4 is a front sectional view of the secondary hearth crematory.

As shown in FIG. 4 divider wall 59 supports afterburner refractory 77 and primary hearth 25. An induced draft blower and venturi 79 is disposed adjacent to chamber side wall 69 and is placed in communication with the afterburner chamber 53 through after burner refractory passage 81. The induced draft blower and venturi 79 serves to exhaust gaseous products of consumption to the outside.

Figure 5:
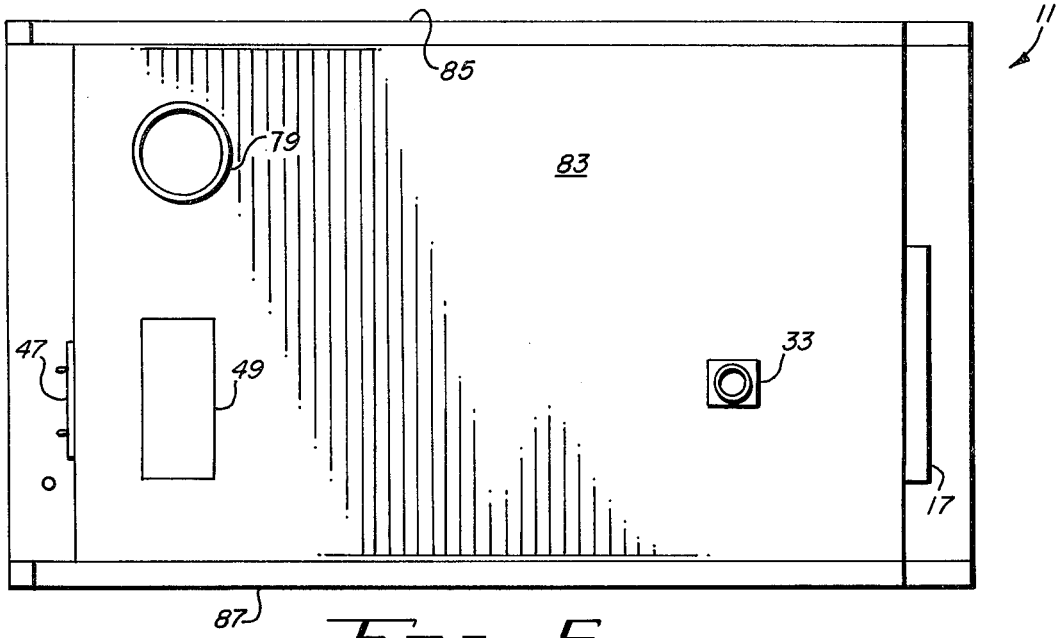
FIG. 5 is a top view of the device.

FIG. 5 shows a top view of the secondary hearth crematory 11 with a top exterior panel 83 and side panels 85 and 87. The panel 83 is provided with adequate passages for the primary burner 33, afterburner 49 and induced draft blower and venturi 79.

Figure 6:
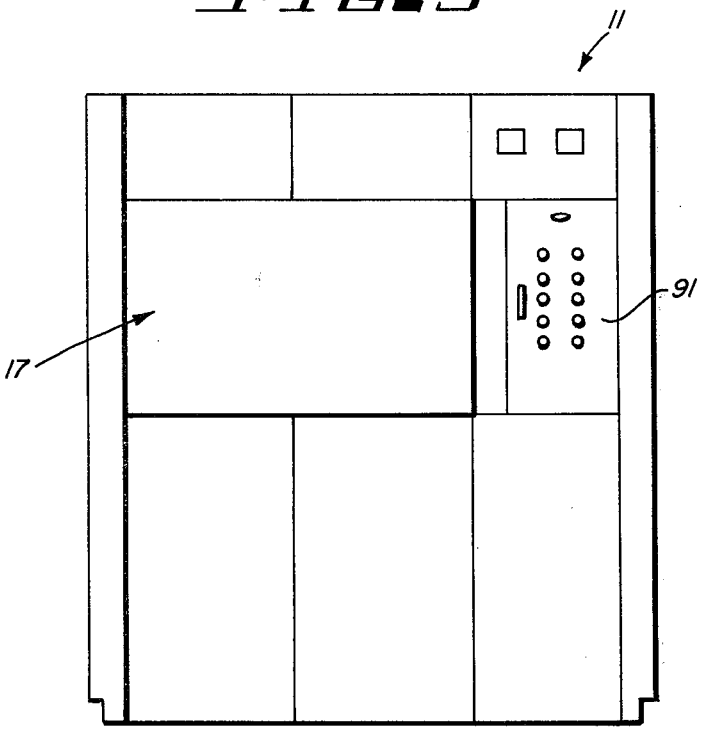
FIG. 6 is a front view of the exterior of the secondary hearth crematory of the present invention.

FIG. 6 shows the frontward appearance of the secondary hearth crematory 11, showing control panel 91 disposed adjacent to charging door 17.

In operation, a body, which may be placed in a casket, is loaded through charging door 17 and placed in the primary cremation chamber 21. Cremation burner 33 supplies heat to the primary cremation chamber, a flow is then induced by the induced draft blower and venturi 79. When the first body is about eighty percent consumed, the first body is relocated onto the secondary hearth 45 and a second body is loaded on the primary hearth 25. At that point the body in the primary hearth 25 will begin consumption and the heat given off together with the heat provided by the afterburner will continue the combustion of the partially consumed body which has been placed on the secondary hearth. Partial consumption thus takes place in the primary chamber 21 and total consumption in the secondary chamber 23. Heat will flow under and over the curtin wall 37 and through flow passages 74 and 75 into afterburner chamber 53. The gases will then flow around divider wall 59 and through afterburner refractory passage 81 to the induced draft blower and venturi, which will carry the exhaust gases to a stack for discharge into the atmosphere. Once the remains in the secondary hearth are fully consumed, the remains removal door 47 is opened and the remains are removed for disposal. The afterburner access door is provided for any maintenance necessary in the afterburner chamber.

In FIG. 7 an alternate embodiment of a secondary hearth crematory 110 is shown in cross-section. As can be seen from FIG. 7, the curtain wall 37 is removed. A guillotine type remains removal door 111 is provided instead of the pivoting type remains removal door 47 of the previous embodiment. The remains removal door 111 is designed so that the top can be at either position or open position 114. Immediately below the guillotine type door 111 is a cooling chamber 117 with a hinged bottom 119 which is provided for easy removal of the cooled remains. A duct 121 is placed in communication with the cooling chamber 117 to provide cooled air from the outside. The duct 121 may be connected to an exterior fan or may be connected to the induced draft blower and venturi 79 of the system (see e.g. FIG. 4). The cooling chamber 117 is used to cool the cremains and to complete the combustion of charcoal particles from the casket by providing fresh air to the still hot cremains. In operation the guillotine type door 111 is opened by lifting to position 115 and a cremains removal tool is used to place the still hot cremains containing glowing particles of charcoal in the cooling chamber 117. The cool air pipes in by duct 121 then cools down the cremains and provides sufficient oxygen to the glowing charcoal particles to complete their combustion. After the cremains are cooled the hinged bottom 119 is opened and the remains are placed in a container to transport them for processing.

Also provided in the embodiment of FIG. 7, and better shown in FIG. 8, is a heat shield 123 which comprises a plurality of fabric strips 125 which may be, for example, about two inches wide and are made of heat reflective material. The fabric strips 125 are suspended from a support member 127 which is attached to the cremator 110. The heat shield is provided to allow operator comfort and safety as well as to prevent or reduce rapid cooling during the time when the main door 17 is open. The shield allows the casket to pass through during the loading procedure and allows the operator access with the tools required to reposition the remains, clean the hearth, or inspect the chamber without being subject to undue discomfort from radiant heat from the primary cremation chamber 21.

I claim:

1. A device for cremating bodies comprising:

a primary hearth of refractory material disposed to support the body;

two refractory side walls of dense brick each connected to respective sides of said primary hearth;

a top member connected to said side walls and having a passage therethrough a loading door coupled to the front of said primary hearth, sidewalls and top member and adapted to admit a body, means for heating said primary hearth so that the body is partially consumed; thereby yielding products of consumption;

a secondary hearth of refractory material adapted to support the partially consumed body;

two secondary side walls, one of said walls disposed to each side of said secondary hearth;

a remains removal door coupled to said secondary hearth and adapted to remove the totally consumed body; and a curtain wall of refractory material disposed between said primary hearth and said secondary hearth said curtain wall defining an upper and lower passage and;

guide walls angularly disposed between said primary and secondary hearth whereby a throat is formed between said primary and secondary hearth.

2. A device in accordance with claim 1 wherein said means for heating comprises:

a cremation burner adjacent to said primary hearth.

3. A device in accordance with claim 1 wherein said remains removal door is a guillotine-type door which can be lifted to provide access to the secondary hearth.

4. A device in accordance with claim 3 further comprising a heat shield disposed adjacent to the loading door; a cooling chamber disposed immediately below the remains removal door; means for providing air to the cooling chamber; and means for removing the cool remains from the cooling chamber.

5. A device in accordance with claim 1 further comprising:

Means in communication with said secondary hearth for after-burning gaseous by-products of consumption.

6. A device in accordance with claim 5 wherein said means for afterburning comprises:

an afterburner chamber in communication with said secondary hearth, and an induced draft blower venturi coupled to said afterburner chamber, whereby all gaseous by-products can be totally consumed and exhausted.

7. A device in accordance with claim 6 wherein said means for afterburning further comprises at least one passage disposed adjacent to said means for forming of throat, and communicating with said afterburning chamber.

* * * * *